US008025101B2

(12) United States Patent
Hansen et al.

(10) Patent No.: US 8,025,101 B2
(45) Date of Patent: Sep. 27, 2011

(54) CYCLIC STEAM STIMULATION METHOD WITH MULTIPLE FRACTURES

(75) Inventors: Kirk Samuel Hansen, Rijswijk (NL); Chia-Fu Hsu, Rijswijk (NL); Alexander Michiel Mollinger, Rijswijk (NL)

(73) Assignee: Shell Oil Company, Houston, TX (US)

( * ) Notice: Subject to any disclaimer, the term of this patent is extended or adjusted under 35 U.S.C. 154(b) by 203 days.

(21) Appl. No.: 12/303,621

(22) PCT Filed: Jun. 6, 2007

(86) PCT No.: PCT/EP2007/055550

§ 371 (c)(1),
(2), (4) Date: Mar. 6, 2009

(87) PCT Pub. No.: WO2007/141287

PCT Pub. Date: Dec. 13, 2007

(65) Prior Publication Data

US 2010/0101790 A1 Apr. 29, 2010

(30) Foreign Application Priority Data

Jun. 8, 2006 (EP) ..... 06115127

(51) Int. Cl.
*E21B 43/24* (2006.01)
*E21B 43/26* (2006.01)

(52) U.S. Cl. ..... 166/272.2; 166/223; 166/263; 166/272.3; 166/272.7; 166/308.1

(58) Field of Classification Search ..... 166/272.2, 166/272.7, 222, 223, 271, 272.3, 303, 308.1
See application file for complete search history.

(56) References Cited

U.S. PATENT DOCUMENTS

| | | | | |
|---|---|---|---|---|
| 3,421,583 | A | 1/1969 | Koons | 166/10 |
| 5,085,276 | A | 2/1992 | Rivas et al. | 166/303 |
| 5,305,829 | A | 4/1994 | Kumar | 166/245 |
| 5,361,856 | A * | 11/1994 | Surjaatmadja et al. | 175/67 |
| 5,957,202 | A * | 9/1999 | Huang | 166/272.3 |
| 6,158,510 | A * | 12/2000 | Bacon et al. | 166/272.7 |
| 6,257,334 | B1 * | 7/2001 | Cyr et al. | 166/272.7 |
| 7,228,908 | B2 * | 6/2007 | East et al. | 166/308.2 |
| 7,441,603 | B2 * | 10/2008 | Kaminsky et al. | 166/308.1 |
| 2003/0131989 | A1 * | 7/2003 | Zakiewicz | 166/245 |
| 2005/0263284 | A1 | 12/2005 | Justus | 166/281 |
| 2007/0199697 | A1 * | 8/2007 | Hocking | 166/250.1 |

FOREIGN PATENT DOCUMENTS

| | | |
|---|---|---|
| CA | 2219513 | 5/1999 |
| EP | 0644316 | 3/1995 |

* cited by examiner

*Primary Examiner* — George Suchfield

(57) ABSTRACT

A cyclic steam soak (CSS) stimulation method for producing heated hydrocarbons from a viscous hydrocarbon-containing formation comprises the steps of: a) drilling a well (1) having a substantially horizontal or inclined lower section (3) into the viscous hydrocarbon-containing formation (4) substantially along the trajectory of the minimum compressive horizontal stress Sh; b) cutting at selected intervals along the length of the lower well section (3) substantially disk-shaped cavities (5A-5D) into the viscous hydrocarbon-containing formation (4) by a rotating hydraulic jet cutting device (6); c) completing the well (1); d) injecting steam into the well (1) and disk-shaped cavities (5A-5D) at such an elevated pressure that the hydraulic pressure in at least one disk-shaped cavity 5A is above the formation fracturing pressure, thereby fracturing the formation (4) and permitting the steam to invade the formation surrounding the fracture and to heat hydrocarbons in the steam invaded zone; e) interrupting steam injection and producing heated hydrocarbons via the well (1); and f) repeating steps (d) and (e) a number of times.

9 Claims, 5 Drawing Sheets

CYCLIC STEAM STIMULATION METHOD WITH MULTIPLE FRACTURES

PRIORITY CLAIM

The present application claims priority of European Patent Application No. 06115127.0 filed 8 Jun. 2006.

BACKGROUND OF THE INVENTION

The invention relates to a cyclic steam stimulation (CSS) method for producing heated hydrocarbons from a viscous hydrocarbon-containing formation.

Canadian patent 2219513 discloses a cyclic steam stimulation (CSS) process wherein during an initial heating step steam is injected into a viscous hydrocarbon-containing formation through steam injection nozzles that are located at several locations along the length of a substantially horizontal lower section of a well and wherein during a subsequent production step heated hydrocarbons are produced back via the nozzles to the wellhead. The steps of steam injection and subsequently producing hydrocarbon are cyclically repeated until a substantial fraction of hydrocarbons has been produced from the formation.

A common disadvantage of the known CSS methods is that the depth of steam penetration into the formation is limited and that, if fractures are formed, their locations are difficult to control, thereby resulting in an uncontrollable and inefficient heating of the hydrocarbon formation. Field experiences also indicate that, at most, only a couple of fractures can be created by the known method, leaving large parts of the formation unheated for an extended period.

The method described in Canadian patent 2219513 proposes using nozzles to regulate and distribute steam injection more uniformly along the well. However, the disadvantage of this method is that the oil production rate from the same well will be significantly lowered by the restricted flow through the nozzles because of the lower mobility of oil relative to the injected steam.

U.S. patent application US2005/0263284 discloses a method for perforating and fracturing a formation using fluid jets that are located at various longitudinally and circumferentially spaced locations in a liner to initiate microfractures that are oriented in different directions relative to the wellbore.

It is an object of the present invention to provide a novel cyclic steam stimulation (CSS) method that not only heats the formation much faster and in a more uniform manner but also produces oil much faster than the known CSS methods including the method described in Canadian patent 2219513.

It is a further object of the present invention to provide a novel cyclic steam stimulation (CSS) method, which yields a reservoir heating pattern that is suitable for implementing a follow-up steam-drive process.

SUMMARY OF THE INVENTION

In accordance with the invention there is provided a cyclic steam stimulation method for producing heated hydrocarbons from a viscous hydrocarbon-containing formation, comprising the following steps:

a) drilling a well having a substantially horizontal or inclined lower section into the viscous hydrocarbon-containing formation substantially along the trajectory of the minimum compressive horizontal stress Sh;

b) cutting at selected intervals along the length of the lower well section substantially disk-shaped cavities into the viscous hydrocarbon-containing formation by a rotating hydraulic jet cutting device;

c) completing the well;

d) injecting steam into the well and disk-shaped cavities at such an elevated pressure that the hydraulic pressure in at least one disk-shaped cavity is above the formation fracturing pressure, thereby fracturing the formation and permitting the steam to invade the formation surrounding the fracture and to heat hydrocarbons in the steam invaded zone;

e) interrupting steam injection and producing heated hydrocarbons via the well; and f) repeating steps (d) and (e) a number of times. Optionally, after step (f) the well is placed on continuous production whilst steam is injected continuously to a new well drilled near an upper portion of the viscous hydrocarbon-containing formation.

The rotating hydraulic jet cutting device may comprise at least one jet nozzle which is induced to cut a disk-shaped cavity by ejecting fluid in a substantially orthogonal direction relative to a longitudinal axis of the lower well section whilst rotating the nozzle relative to said longitudinal axis and maintaining the nozzle at a fixed position along the length of said longitudinal axis.

During a first cycle of steam injection in accordance with step (d) initial fractures may be created predominantly in the formation surrounding the disk-shaped cavity, where the stress concentration is relatively high due to the irregular geometry of the intersection of the substantially cylindrical well and the substantially disk-shaped cavity and wherein after sufficient steam injection into the initial fractures, the initial fractures cease to open due to the increased horizontal stress resulting from the temperature rises in the adjacent formation, such that during subsequent cycles of steam injection in accordance with step (d), new fractures are created in the formation surrounding the remaining disk-shaped cavities along the well section.

After a number of cycles of steam injection in accordance with step (d) the average temperature of the formation may be sufficiently high such that both the minimum (Sh) and maximum (SH) compressive horizontal stresses are greater than the vertical compressive stress (SV) and additional fractures are created in substantially low-angle or horizontal orientations.

The viscous hydrocarbon formation, at its initial state, may have a minimum compressive in-situ principal stress that is oriented in a substantially horizontal direction but may with sufficient temperature rise be reoriented to a substantially vertical direction.

The viscous hydrocarbon formation may be a heavy-oil reservoir situated from 200 to 3500 meters from the surface with the oil viscosity ranging from 2000 up to 1000000 cp at the reservoir condition and the method according to the invention may be used to create a root shaped pattern of fractures for accelerating steam injection into and oil production from the viscous hydrocarbon-containing formation.

These and other features, embodiments and advantages of the method according to the invention are described in the accompanying claims, abstract and the following detailed description of preferred embodiments in which reference is made to the accompanying drawings.

DESCRIPTION OF A PREFERRED EMBODIMENT

Figure 1:
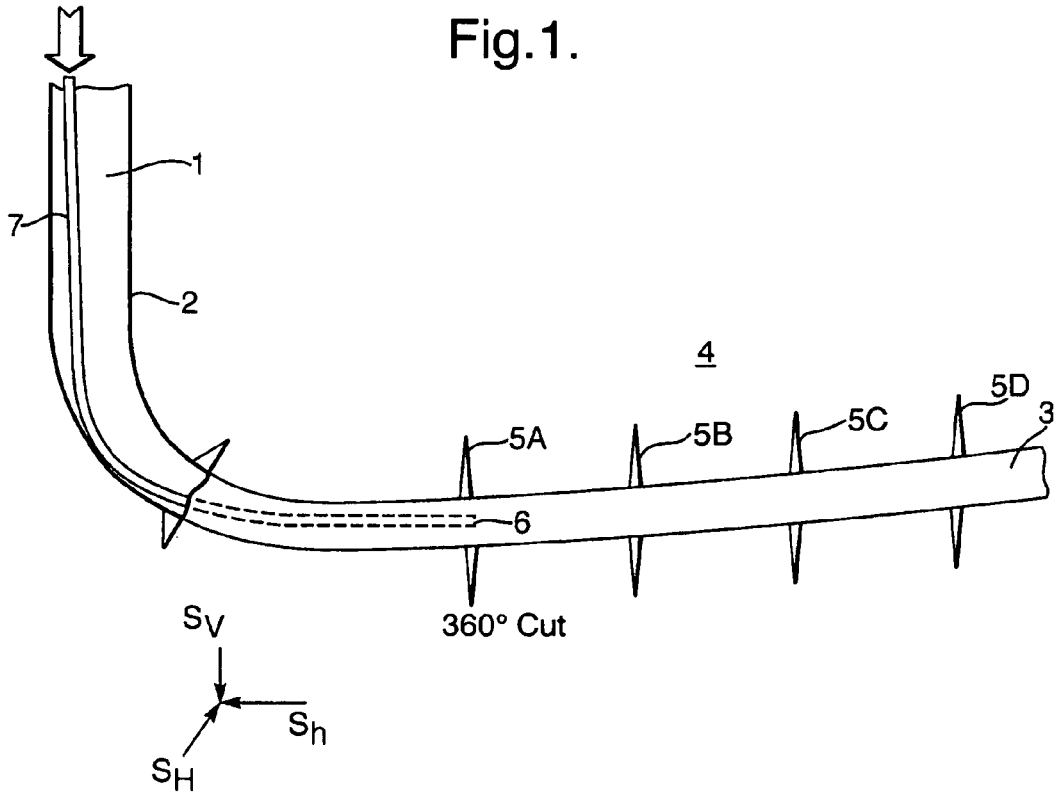
FIG. 1 shows a steam injection and oil production well around which disk-shaped cavities are cut in accordance with the method according to the invention.

FIG. 1 shows a well 1 with a substantially vertical upper section in which a well casing 2 is arranged and a substantially horizontal lower section 3 which penetrates a viscous oil containing formation 4 in which a series of five disk-shaped cavities 5A-D are being cut by a rotating jet cutting device 6.

The jet cutting device 6 is supported and rotated by a coiled tubing or drill string assembly 7, such that the rotating jet cutting device 6 is rotated about a longitudinal axis of the wellbore over at least 360 degrees to cut the disk-shaped cavity 5A in the formation surrounding the wellbore.

FIG. 1 also shows that the formation is subject to a three dimensional combination of minimum and maximum horizontal and vertical compressive stresses Sh, SH and Sv and that the trajectory of the lower well section 3 is oriented substantially along the trajectory of minimum compressive horizontal stress Sh.

Figure 2:
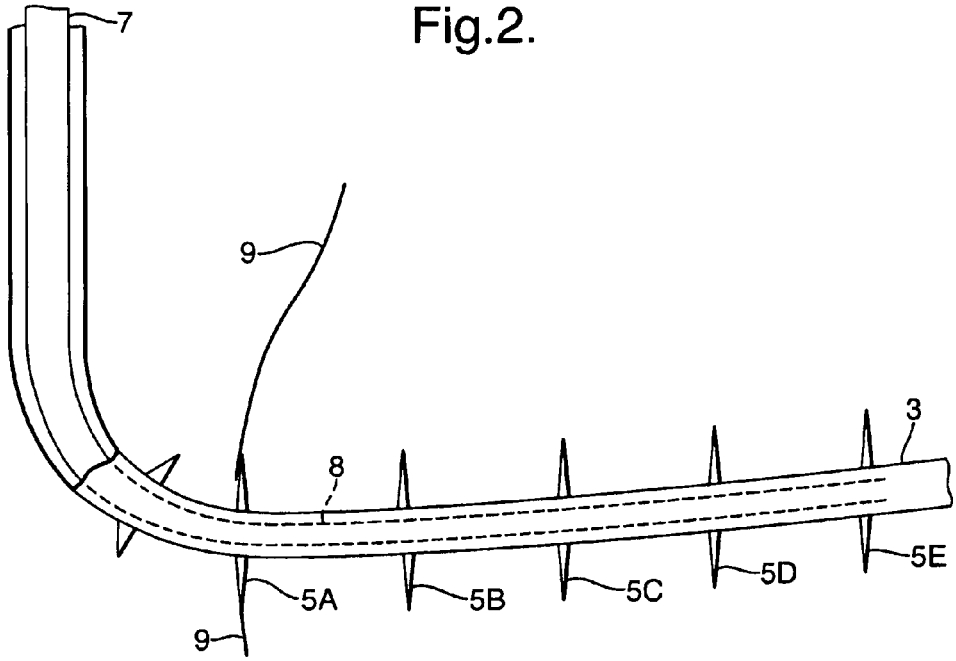
FIG. 2 shows how during an initial steam soak injection cycle a fracture is created in the formation surrounding a disk-shaped cavity, which is located closest to the wellhead.

FIG. 2 shows how steam is injected through a production tubing 7, which is optionally provided with a sandscreen 8 that extends through the horizontal lower section 3 of the well shown in FIG. 1, around which a series of six disk-shaped cavities 5A-E have been cut at regular intervals along the length of the horizontal lower section 3. The steam is injected at such a high pressure that the formation surrounding the uppermost disk-shaped cavity 5A is fractured such that a first fracture 9 extends substantially radially outward from the uppermost disk-shaped cavity 5A.

Figure 3:
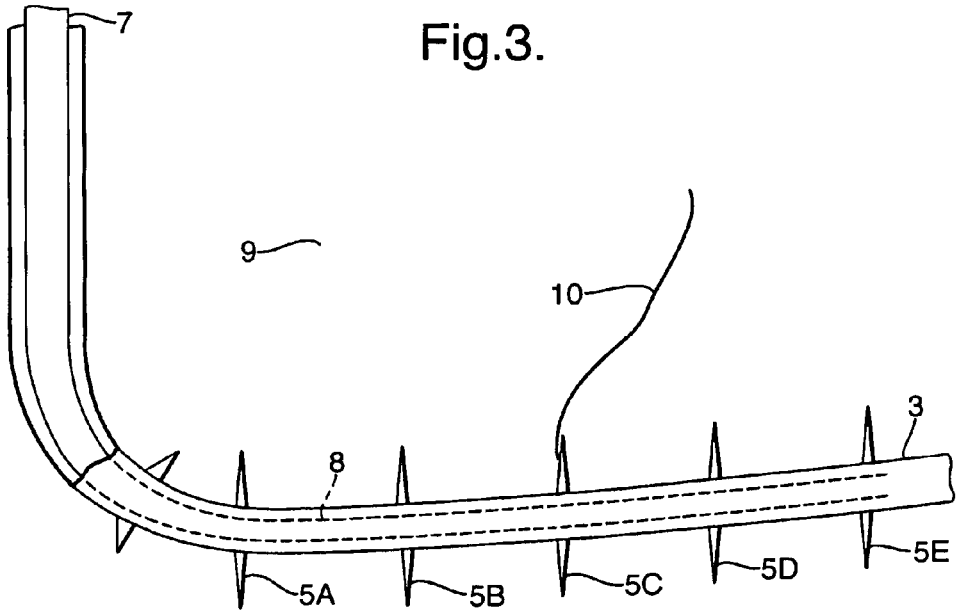
FIG. 3 shows how during a subsequent steam injection cycle a fracture is created in the formation surrounding a disk-shaped cavity, which is located further away from the wellhead.

FIG. 3 shows how during a subsequent steam injection cycle the first fracture 9 is closed due to increased horizontal stresses Sh and SH resulting from the heating and expansion of the formation surrounding the first fracture 9, whereas a second fracture is created around an intermediate disk-shaped cavity 5C, where the horizontal stresses Sh and SH are not significantly increased as a result of the expansion of the heated formation surrounding the first fracture 5A because of the very low mobility of the viscous crude oil and the low heat transfer through the viscous crude oil containing formation.

Figure 4:
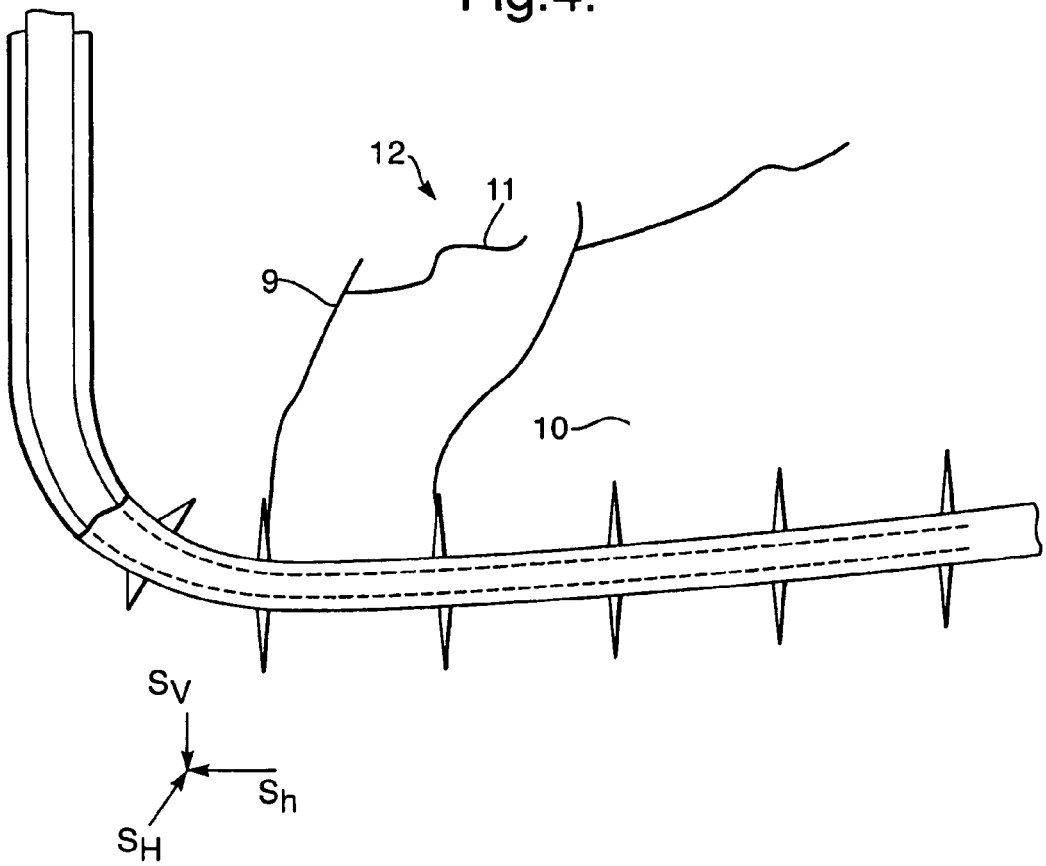
FIG. 4 shows how a network of fractures is created in the formation surrounding a plurality of disk-shaped cavities after a plurality of steam soaking cycles.

FIG. 4 shows how a root-shaped network 12 of principal fractures 9, 10 and branch fractures 11 is created after a series of five or more steam injection and subsequent heated crude oil production cycles, such that five or more cyclic steam soaks (CSS) have been carried out.

Figure 5:
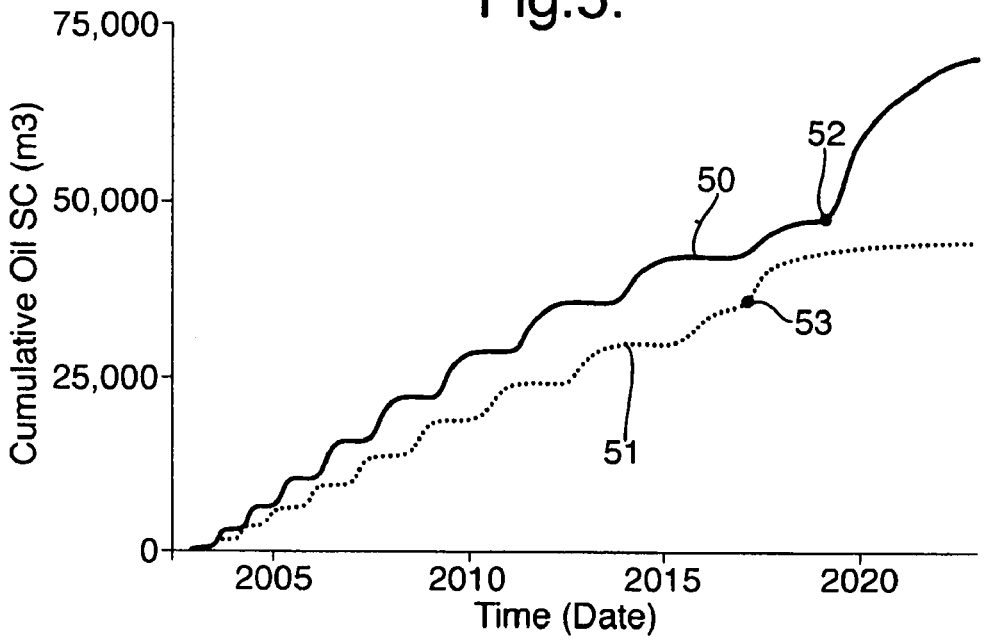
FIG. 5 shows the results of a computer simulation that calculates oil production from a cyclic steam soaked (CSS) well provided with disk-shaped cavities according to the invention and oil production from a prior art CSS well, which is not provided with disk-shaped cavities.

FIG. 5 shows a calculation of oil production calculated by a reservoir simulation computer program, wherein the upper, solid, curve 50 shows the calculated crude oil production from a CSS well 1 which penetrates a formation in which a series of disk-shaped cavities 5A-5E according to the invention are cut in the manner illustrated in FIGS. 1-4 and the lower, dashed, curve 51 shows the calculated crude oil production from a prior art CSS well, which is not surrounded by disk-shaped cavities. The calculated curves illustrate that the crude oil production from a viscous crude oil containing formation is significantly higher by providing disk-shaped cavities 5A-5E around the well 1 in accordance with the invention. The points 52 and 53 illustrate that after a series of CSS steam soaking cycles a conventional steam drive may be started where the well 1 is put on continuous production whilst steam is injected continuously via a dedicated steam injection well (not shown) which may be drilled near an upper portion of the viscous oil containing formation, and that crude oil production from the well 1 surrounded by disk-shaped fractures 5A-5E according to the invention is significantly higher than from the conventional prior art well.

Figure 6:
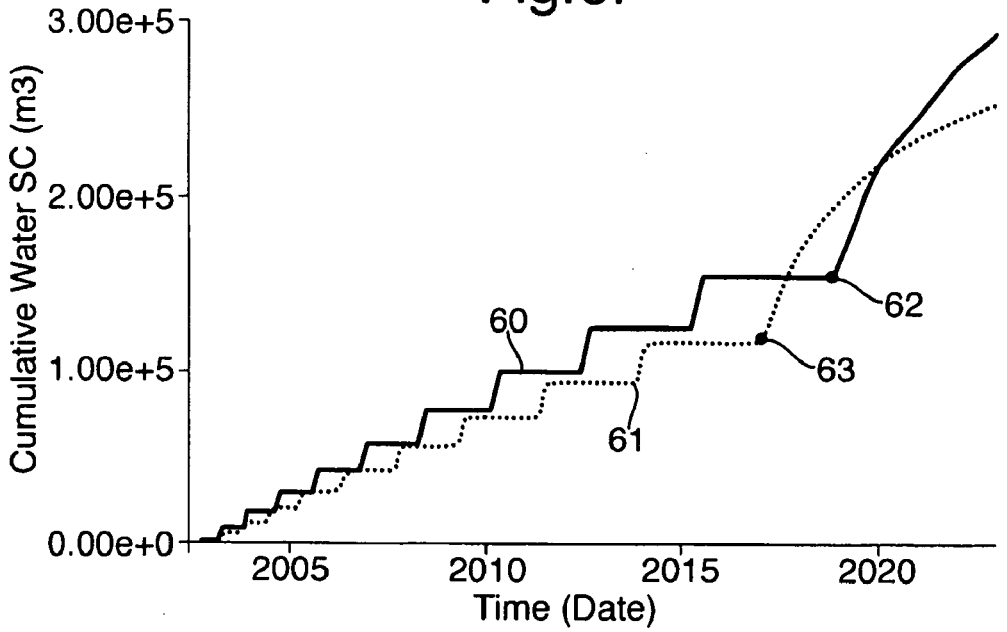
FIG. 6 shows the results of a computer simulation that calculates steam injection rate into a formation surrounding a cyclic steam soaked (CSS) well provided with disk-shaped cavities according to the invention and the stream injection rate into a formation surrounding a prior art CSS well, which is not provided with disk-shaped cavities.

FIG. 6 shows a calculation of steam injection rates calculated by a reservoir simulation computer program, wherein the upper, solid, curve 60 shows the calculated steam injection rate into a formation surrounding a CSS well 1 which penetrates a formation in which a series of disk-shaped cavities 5A-5E according to the invention are cut in the manner illustrated in FIGS. 1-4; and the lower, dashed, curve 61 shows the calculated steam injection rate from a prior art CSS well, which is not surrounded by disk-shaped cavities. The calculated curves illustrate that the steam injection rate into a viscous crude oil containing formation is significantly higher by providing disk-shaped cavities 5A-5E around the well 1 in accordance with the invention. The points 62 and 63 illustrate that after a series of CSS steam soaking cycles a conventional steam drive may be started where the well 1 is put on continuous production whilst steam is injected continuously via a dedicated steam injection well (not shown) which may be drilled near an upper portion of the viscous oil containing formation, and that steam injection into the formation surrounding the well 1 surrounded by disk-shaped fractures 5A-5E according to the invention is significantly higher than from the conventional prior art well.

Figure 7:
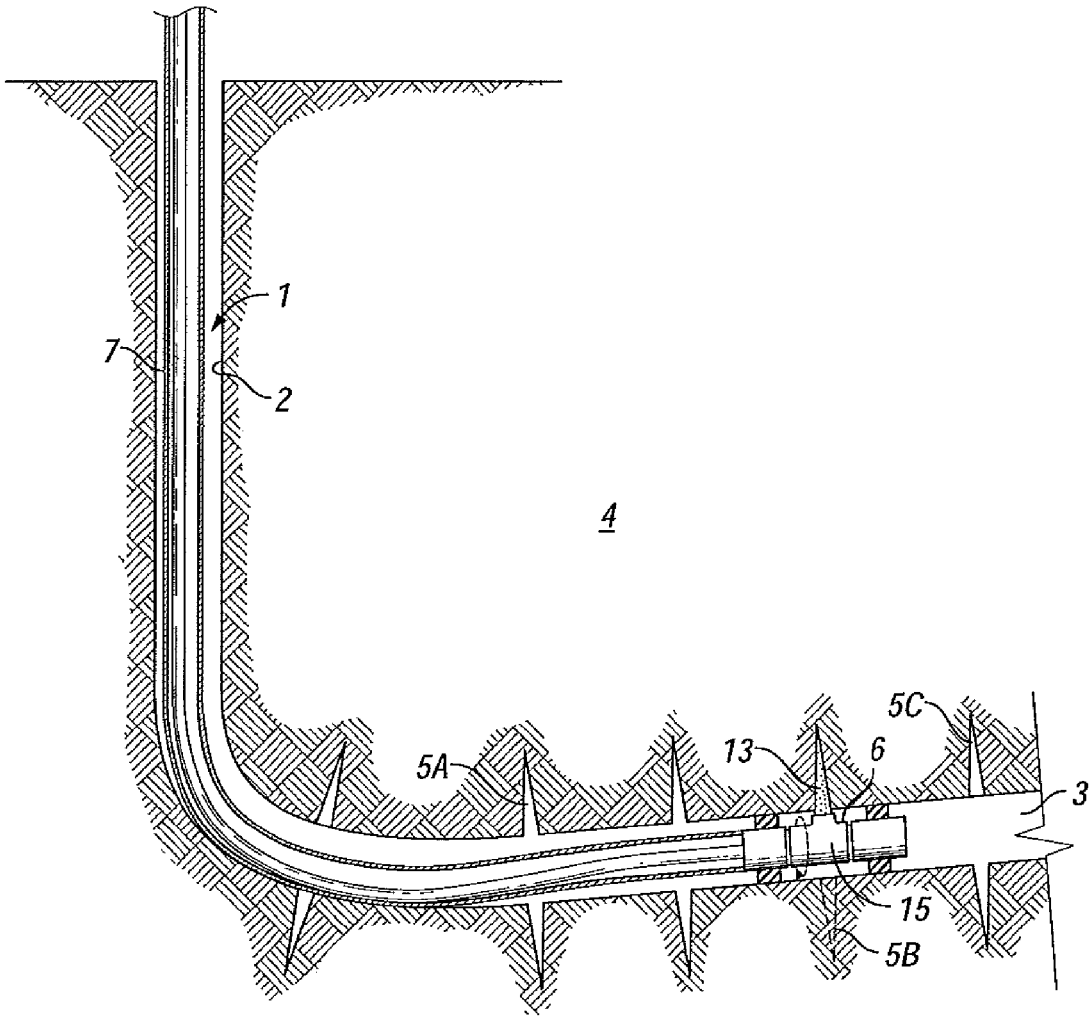
FIG. 7 shows a steam injection and oil production well around which disk-shaped cavities are cut by a rotating hydraulic jet cutting device in accordance with the present invention.

FIG. 7 shows a well 1 with a substantially vertical upper section in which a well casing 2 is arranged and a substantially horizontal lower section 3 which penetrates a viscous oil containing formation 4 in which a series of disk-shaped cavities 5A-C are cut by a rotating hydraulic jet cutting device 6. The rotating hydraulic jet cutting device 6 may comprise at least one jet nozzle 15 which is induced to cut a disk-shaped cavity (e.g. 5B) by ejecting fluid 13 in a substantially orthogonal direction relative to the longitudinal axis of the lower well section whilst rotating the nozzle relative to the longitudinal axis and maintaining the nozzle at a fixed position along the length of the longitudinal axis.

That which is claimed:

1. A cyclic steam stimulation method for producing heated hydrocarbons from a viscous hydrocarbon-containing formation, comprising the following steps:

a) drilling a well having a substantially horizontal or inclined lower section into the viscous hydrocarbon-containing formation substantially along the trajectory of the minimum compressive horizontal stress Sh;

b) cutting at selected intervals along the length of the lower well section substantially disk-shaped cavities into the viscous hydrocarbon-containing formation by a rotating hydraulic jet cutting device;

c) completing the well;

d) injecting steam into the well and disk-shaped cavities at such an elevated pressure that the hydraulic pressure in at least one disk-shaped cavity is above the formation fracturing pressure, thereby fracturing the formation and permitting the steam to invade the formation surrounding the fracture and to heat hydrocarbons in the steam invaded zone;

e) interrupting steam injection and producing heated hydrocarbons via the well; and f) repeating steps (d) and (e) a number of times.

2. The method of claim 1, wherein after step (f) the well is placed on continuous production whilst steam is injected continuously to a new well drilled near an upper portion of the viscous hydrocarbon-containing formation.

3. The method of claim 2, wherein the method is used to create a reservoir heating pattern suitable for implementing a follow-up steam-drive process after cyclic steam stimulation and multiple heated channels are created, which provide connecting paths for the oil production by a steam-drive process.

4. The method of claim 1, wherein the rotating hydraulic jet cutting device comprises at least one jet nozzle which is induced to cut a disk-shaped cavity by ejecting fluid in a substantially orthogonal direction relative to a longitudinal axis of the lower well section whilst rotating the nozzle relative to said longitudinal axis and maintaining the nozzle at a fixed position along the length of said longitudinal axis.

5. The method of claim 1, wherein during a first cycle of steam injection in accordance with step (d) initial fractures are created predominantly in the formation surrounding the disk-shaped cavity, where the stress concentration is relatively higher due to the irregular geometry of the intersection of the substantially cylindrical well and the substantially disk-shaped cavity and wherein after sufficient steam injection into the initial fractures, the initial fractures cease to open due to the increased horizontal stress resulting from the temperature rises in the adjacent formation, such that during subsequent cycles of steam injection in accordance with step (d), new fractures are created in the formation surrounding the remaining disk-shaped cavities along the well section.

6. The method of claim 1, wherein after a number of cycles of steam injection in accordance with step (d) the average temperature of the formation is sufficiently high that both the minimum (Sh) and maximum (SH) compressive horizontal stresses are greater than the vertical compressive stress (SV) and additional fractures are created in substantially low-angle or horizontal orientations.

7. The method of claim 1, wherein a viscous hydrocarbon formation, at its initial state, has a minimum compressive in-situ principal stress that is oriented in a substantially horizontal direction but will with sufficient temperature rise be reoriented to a substantially vertical direction.

8. The method of claim 1, wherein the viscous hydrocarbon formation is a heavy-oil reservoir situated from 200 to 3500 meters from the surface with the oil viscosity ranging from 2000 up to 1000000 cp at the reservoir condition.

9. The method of claim 1, wherein the method creates a root shaped pattern of fractures for accelerating steam injection into and oil production from the viscous hydrocarbon-containing formation.

* * * * *